US008047586B2

(12) United States Patent
Pilotelli

(10) Patent No.: US 8,047,586 B2
(45) Date of Patent: Nov. 1, 2011

(54) LOCK DEVICE

(75) Inventor: Carlo Pilotelli, Brescia (IT)

(73) Assignee: Giacinto Rivadosssi S.p.A., Agnosine (IT)

( * ) Notice: Subject to any disclaimer, the term of this patent is extended or adjusted under 35 U.S.C. 154(b) by 0 days.

(21) Appl. No.: 12/411,519

(22) Filed: Mar. 26, 2009

(65) Prior Publication Data

US 2009/0211318 A1 Aug. 27, 2009

Related U.S. Application Data

(63) Continuation of application No. PCT/IT2006/000695, filed on Sep. 29, 2006.

(51) Int. Cl.
*E05B 15/02* (2006.01)
*E05B 3/00* (2006.01)

(52) U.S. Cl. ..... 292/357; 292/336.3; 292/347; 292/356; 292/DIG. 53; 292/DIG. 64

(58) Field of Classification Search ..... 292/347–350, 292/352, 355, 356, 336.3, 357–359, DIG. 53, 292/DIG. 54, DIG. 60, DIG. 64; 70/224
See application file for complete search history.

(56) References Cited

U.S. PATENT DOCUMENTS

| | | | | |
|---|---|---|---|---|
| 2,825,220 | A | 3/1958 | Glass | |
| 5,236,235 | A * | 8/1993 | Gustafson et al. | 292/357 |
| 5,265,924 | A * | 11/1993 | Kim | 292/336.3 |
| 5,441,318 | A * | 8/1995 | Ghostley | 292/336.3 |
| 5,481,890 | A * | 1/1996 | Millman | 70/224 |
| 5,490,700 | A * | 2/1996 | Zuckerman | 292/357 |
| 5,564,296 | A * | 10/1996 | Theriault et al. | 70/224 |
| 5,605,064 | A * | 2/1997 | Katayama et al. | 70/224 |
| 5,718,468 | A * | 2/1998 | Qureshi et al. | 292/347 |
| 5,727,406 | A * | 3/1998 | Banducci | 70/224 |
| 5,732,578 | A * | 3/1998 | Kang | 70/224 |
| 5,761,936 | A * | 6/1998 | Katayama | 70/224 |
| 6,038,894 | A * | 3/2000 | Hu | 70/224 |
| 6,048,007 | A * | 4/2000 | Shor | 292/348 |
| 6,279,360 | B1 | 8/2001 | Shen | |
| 6,363,569 | B1 | 4/2002 | Kotlarski | |
| 6,598,440 | B1 * | 7/2003 | Armstrong | 70/472 |

(Continued)

FOREIGN PATENT DOCUMENTS

EP 1 510 636 A1 3/2005

(Continued)

OTHER PUBLICATIONS

International Search Report received in corresponding International Patent Application No. PCT/IT2006/000695 dated Nov. 23, 2007 (5 pages).

*Primary Examiner* — Carlos Lugo
*Assistant Examiner* — Alyson M Merlino
(74) *Attorney, Agent, or Firm* — Keating & Bennett, LLP

(57) ABSTRACT

The present invention relates to a lock device for a door of the type with seating unit through the door shutter. The seating unit has a first seating body, a second seating body, a first cover and a second cover. There are provided connecting elements, generally self-tapping screws, that engage both the first cover to the first seating body and the second cover, closing the second seating body as a package thereinbetween. Among the other things, the lock device allows a wide rotation of the handle.

3 Claims, 4 Drawing Sheets

U.S. PATENT DOCUMENTS

| | | | | |
|---|---|---|---|---|
| 6,644,077 | B1 | 11/2003 | Huang | |
| 6,681,605 | B1 | 1/2004 | Huang | |
| 6,802,546 | B2 * | 10/2004 | Bates et al. | 292/358 |
| 6,880,872 | B2 * | 4/2005 | Eller et al. | 292/357 |
| 7,137,657 | B2 * | 11/2006 | Wu et al. | 292/357 |
| 2004/0237608 | A1 | 12/2004 | Chen | |
| 2004/0245788 | A1 | 12/2004 | Lin | |
| 2006/0055183 | A1 | 3/2006 | Wheatland | |

FOREIGN PATENT DOCUMENTS

| | | | |
|---|---|---|---|
| EP | 1 544 384 | A1 | 6/2005 |
| WO | WO 01/38675 | A1 | 5/2001 |

* cited by examiner

LOCK DEVICE

This application is a continuation of International Application No. PCT/IT2006/000695, filed Sep. 29, 2006.

FIELD OF THE INVENTION

The object of the present invention is a lock device for doors of the type with through seating unit.

BACKGROUND OF THE INVENTION

The lock devices of the above type comprise a handle, a square pin, handle return means, an engagement unit and seating unit, placed through the door shutter thickness.

The seating unit is inserted through the door shutter, in an especially made hole. The square pin is inserted through the unit, at the end thereof there are mounted the handles; the return means are seated in the unit and are engaged with the square pin; the square pin is also engaged with the engagement unit, comprising an engagement element, in the jargon called "bolt", suitable for engaging the door shutter to the jamb thereof, for keeping the door closed.

The seating unit must meet several requirements, to make a durable lock device functional to the requirements of user and installer.

In particular, the seating unit must make a suitable support for the handles, often heavy, and must reliably absorb the actions relieved thereon for the repeated actuations of the handles.

For installation requirements, the seating unit comprises two bodies slidingly associable to one another, for adapting the unit to different dimensions of the door shutter thickness.

To make a unit sufficiently resistant to the above actions it is therefore necessary that the two component bodies thereof are strongly engaged to each other.

In known embodiments, such requirement is partly met through screws that engage the two unit bodies.

The bodies seat the elastic return means, so there are provided covers for covering the return means seating rooms. Also the covers must be strongly engaged with the bodies.

In known embodiments, such requirement is met through three screws that engage the covers to the bodies.

The above requirements create a set of structural hindrances inside the seating unit that strongly limit the available angle of rotation for the handle rotation.

SUMMARY OF THE INVENTION

The object of the present invention is to make a lock device of the type with through seating unit which should meet the above requirements and which should provide a wide angle of rotation for the handle.

Such object is achieved by a lock device for a door comprising:

at least one handle suitable for being gripped and turned from a rest configuration to an actuation configuration;

an engagement unit suitable for engaging the door shutter to a jamb thereof in a forward configuration and suitable for releasing shutter from the jamb in a retracted configuration;

connecting means suitable for mechanically connecting handle with engagement unit, so that the rest configuration of the handle corresponds to the forward configuration of the engagement unit and the actuation configuration of the handle corresponds to the retracted configuration of the engagement unit;

return means suitable for constantly influencing the handle from the actuation configuration to the rest configuration;

a seating unit suitable for being mounted through the door shutter, the handle and the engagement unit being coupled to the seating unit, seating unit comprising a) a first seating body and a second seating body, reciprocally engaged so as to form an intermediate room wherein the engagement unit engages with the connecting means, seating bodies exhibiting each a front room wherein there are seated return means;

a first cover suitable for being associated to first seating body for covering, at least partly, front room;

connecting means suitable for mechanically connecting first cover to first seating body, wherein the connecting means are suitable for concurrently influencing also second seating body, holding it to first seating body.

DESCRIPTION OF PREFERRED EMBODIMENTS

Figure 1:
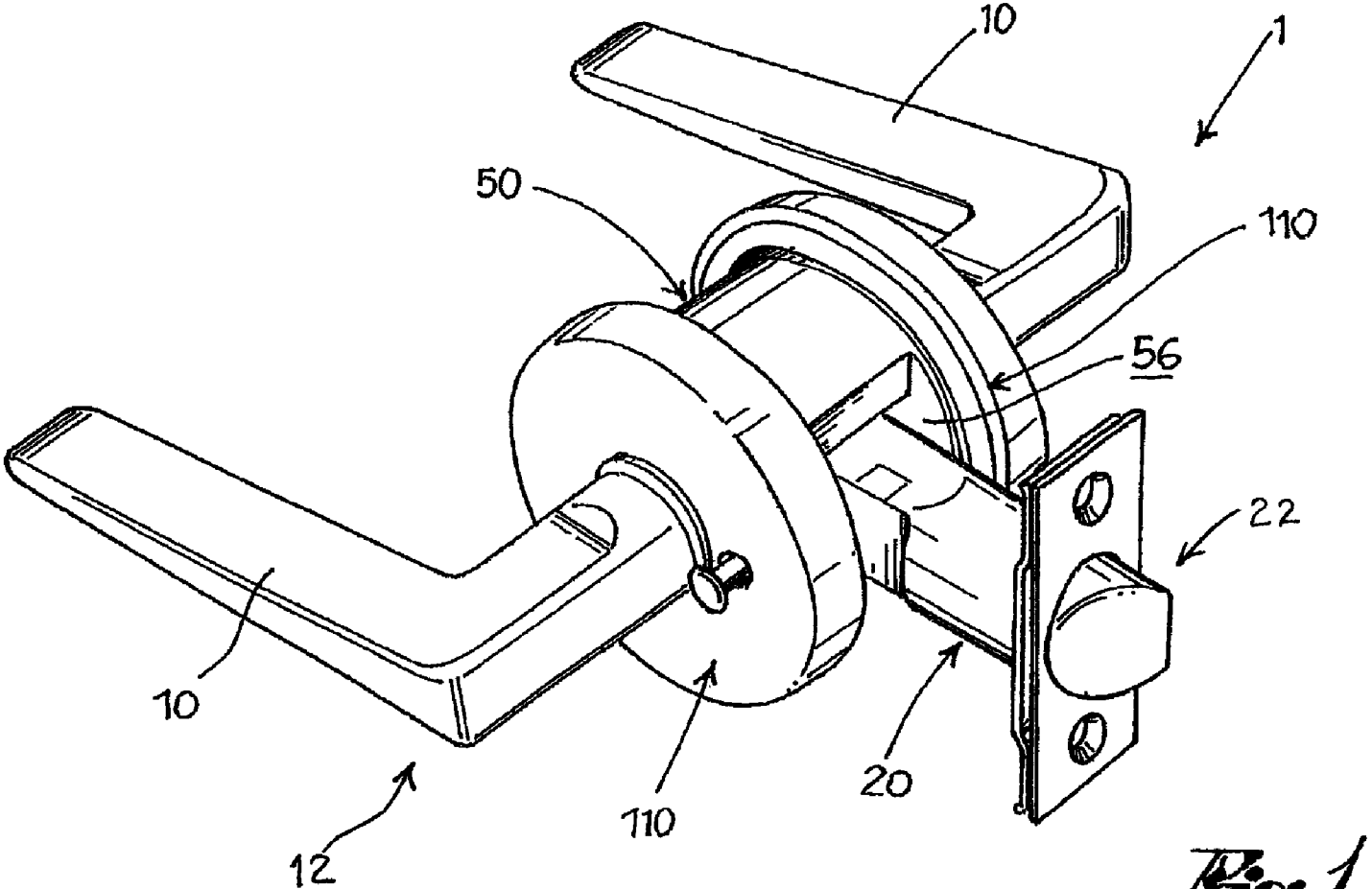
FIG. 1 shows a perspective view of a lock device comprising a seating unit according to the present invention.
Figure 2:
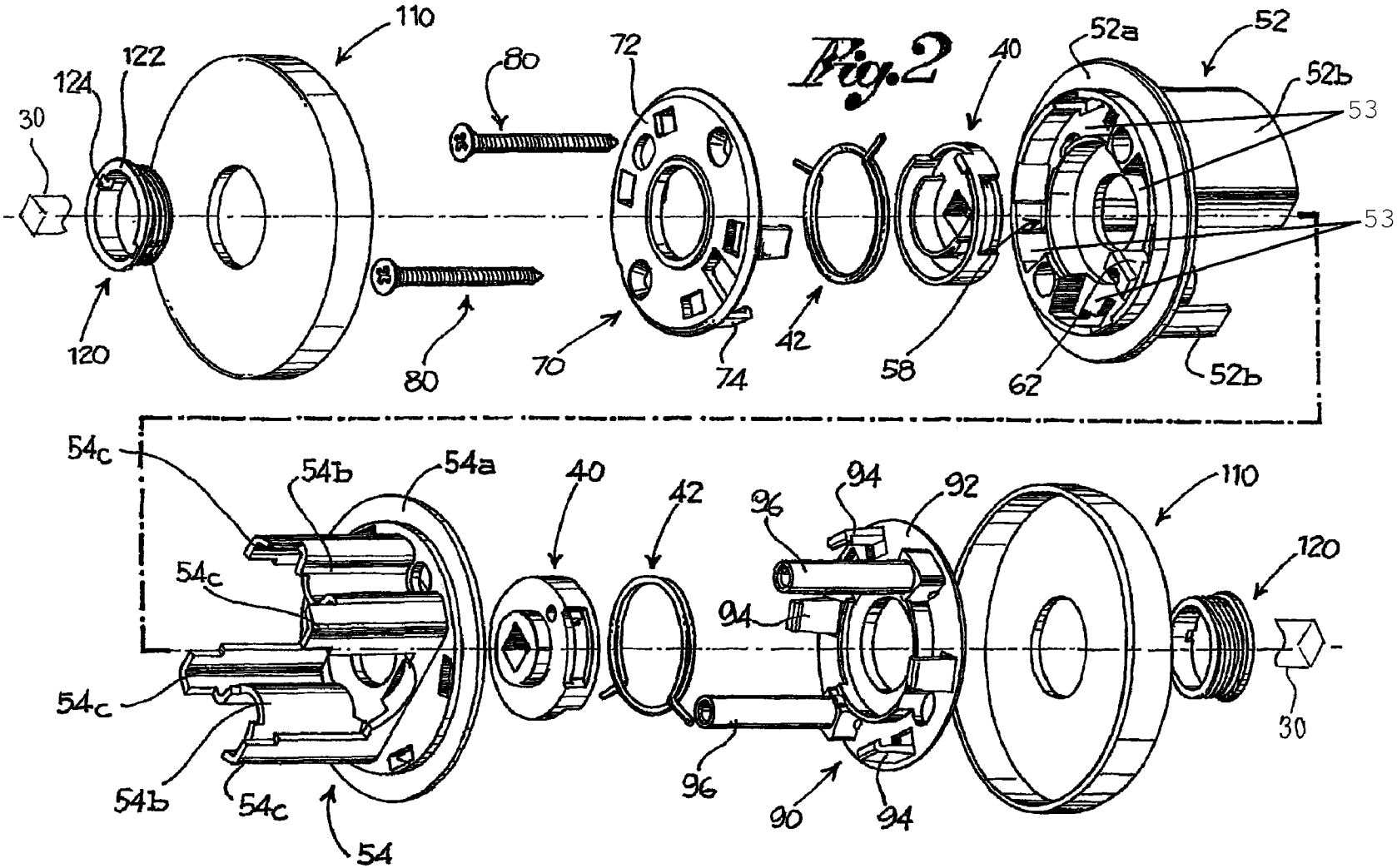
FIG. 2 shows a perspective exploded view of the seating unit of FIG. 1.
Figure 3:
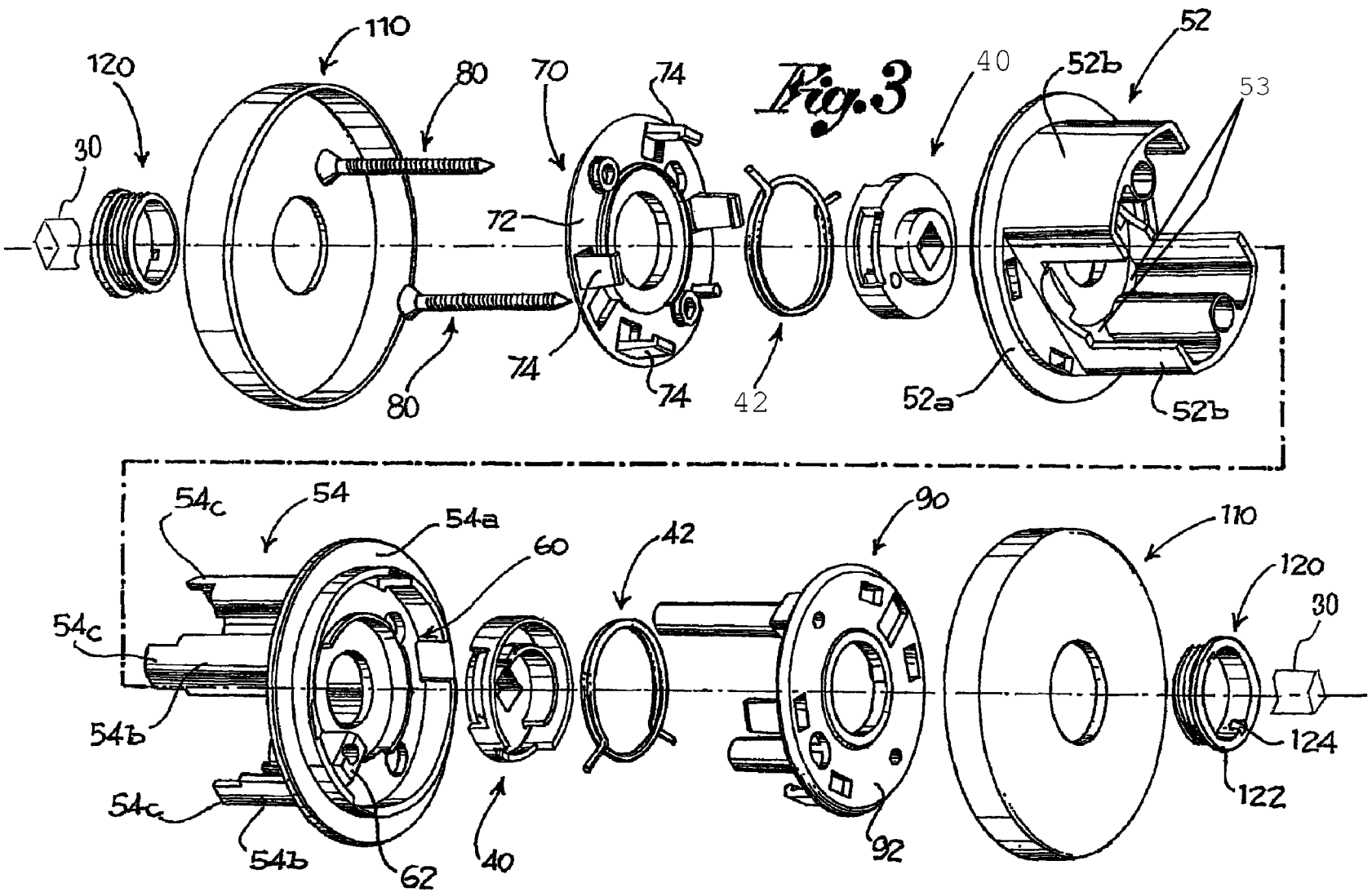
FIG. 3 shows a further perspective view of the seating unit of FIG. 2.
Figure 5B:
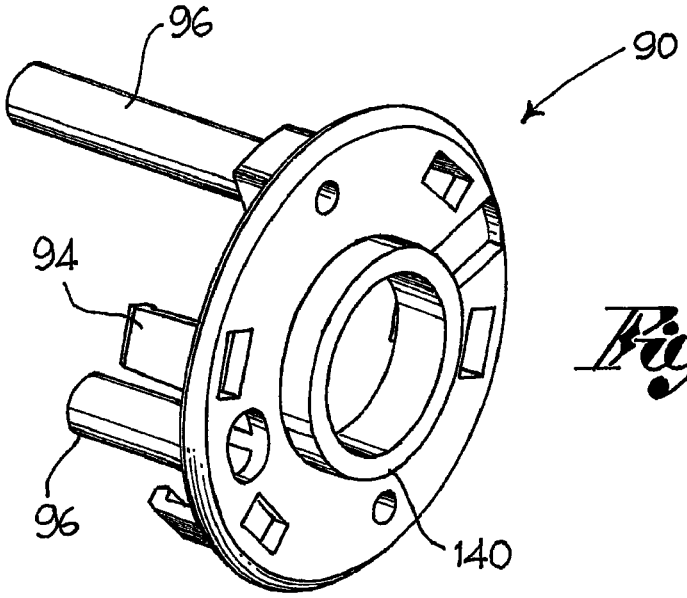
FIGS. 5*a* and 5*b* show further embodiment variations of covers of the seating unit of FIGS. 2 and 3.
Figure 5A:
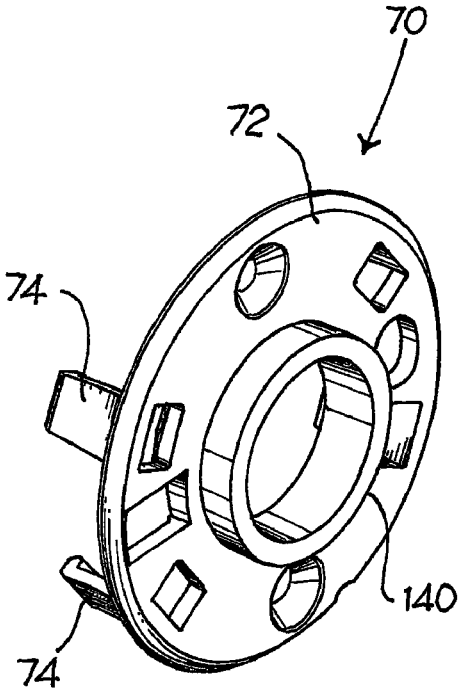
Figure 4B:
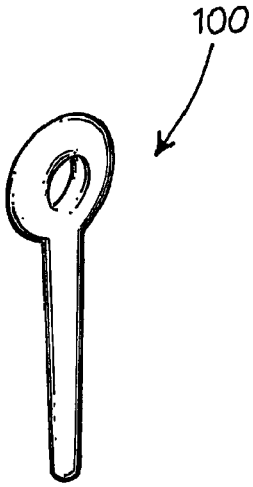
FIG. 4*b* shows an unlock key for the lock device according to the present invention.
Figure 4A:
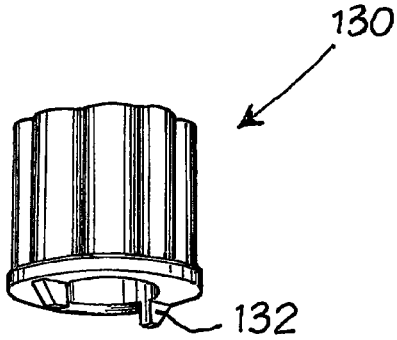
FIG. 4*a* shows a view of a mounting bush for the seating unit according to the present invention.

With reference to the annexed figures, reference numeral 1 globally denotes a lock device for a door.

Hereinafter, reference is made to an "axial" direction to indicate with such term a direction along the door shutter thickness.

The lock device comprises at least one handle 10 suitable for being gripped and turned from a rest configuration 12, wherein it remains when it is not influenced by a user, to an actuation configuration, wherein it is turned relative to the previous configuration.

The lock device 1 further comprises an engagement unit 20 suitable for engaging the door shutter to a jamb thereof in a forward configuration 22 and suitable for releasing the shutter from the jamb in a retracted configuration.

The lock device further comprises connecting means 30 suitable for mechanically connecting handle 10 with the engagement unit 20, so that the rest configuration 12 of handle 10 corresponds to the forward configuration 22 of the engagement unit 20 and the actuation configuration of handle 10 corresponds to the retracted configuration of the engagement unit 20.

According to a preferred embodiment, connecting means 30 comprise a square pin having axial prevailing extension and such length as to cross the door shutter axially and protrude therefrom from one side and the other.

Moreover, lock device 1 comprises return means suitable for constantly influencing handle 10 from the actuation configuration to the rest configuration.

According to a preferred embodiment, return means comprise a spring holder body 40 and a spring 42, seated in the spring holder body 40 and engaged with the latter to influence it in rotation.

Moreover, the lock device 1 comprises a seating unit 50 suitable for being mounted through the door shutter.

The seating unit 50 is coupled to handle 10 and engagement unit 20.

The seating unit 50 comprises a first seating body 52 and a second seating body 54, reciprocally engaged so as to form an intermediate room 56 wherein the engagement unit 20 engages with the connecting means 30, that is, with the square pin.

Moreover, each seating body 52, 54 exhibits a front room 58, 60, wherein there are seated return means.

In particular, the front room 58, 60 exhibits a recess wherein there is inserted the spring holder body 40. Inside the spring holder body 40 there is seated spring 42 that protrudes with the ends thereof from spring holder body 40.

Peripherally to the front room 58, 60, the seating bodies 52, 54 comprise a fixed stop 62, comprised in return means, with which spring 42 is engaged to be under tension.

According to a preferred embodiment, the fixed stop 62 exhibits stop faces, with which spring 42 engages, turned relative to the horizontal of a recovery angle.

Preferably, recovery angle is comprised within the interval 1-5 hexadecimal degrees. Especially suitable for compensating the weight of the handles usually used, that thus arrange perfectly aligned with the horizontal, is a recovery angle equal to 3 hexadecimal degrees.

Moreover, the seating unit comprises a first cover 70 associated to first seating body 52 for covering, at least partly, the front room 58.

According to a preferred embodiment, the first cover 70 comprises a cover body 72 that covers room 58 and at least one tab 74 peripherally axially protruding from the cover body 70. Tab 74 is suitable for engaging snap-wise, preferably in a releasable manner, with the first seating body 52.

Tab 74 is a preferred example of snap-wise connecting means.

According to a preferred embodiment, the first cover 70 comprises four tabs 74 arranged in diametrically opposite pairs.

Preferably, between a first tab and the immediately adjacent tab advancing in clockwise direction there is a reduced angular distance whereas between the first tab and the immediately adjacent tab in counter clockwise direction there is a high angular distance. The high angular distance is more than the reduced angular distance.

The lock device 1 further comprises connecting means suitable for mechanically connecting the first cover 70 to the first seating body. Connecting means are suitable for concurrently influencing also the second seating body 54, holding it to the first seating body 52.

Preferably, the connecting means comprise at least a single connecting element 80 that engages the first cover 70 to the first seating body 52 and keeps the second body 54 to the first seating body 52.

Preferably, the connecting means comprise a pair of connecting elements 80, arranged diametrically opposite relative to the first cover 70.

Preferably, the connecting elements 80 are screws, for example self-tapping.

According to a preferred embodiment, the connecting elements 80 are arranged between tabs 74 having high angular distance.

Advantageously, the connecting elements concurrently connect the first cover 70 to the first seating body 52 and pull the second seating body 54 towards the first body 52, thus making a compact unit suitable for withstanding the actions relieved thereon by actuating the handle.

Even more advantageously, the first cover 70 is coupled to the first seating body 52 through peripheral tabs that make the cover edge adhere perfectly to the seating body edge.

According to a preferred embodiment, the lock device 1 comprises a second cover 90 associated to the second seating body 54 for covering at least partly the front room 60.

Preferably, the connecting means comprise second cover 90. In other words, screws 80 engage the second cover 90, holding it to the second seating body 54 while pulling the second seating body 54 towards the first body 52.

Also the second cover 90, like the first cover 70, comprises a cover body 92 and tabs 94 axially projecting therefrom.

Moreover, the second cover 90 further comprises at least one tubular element 96 axially projecting from the cover body 92. tubular element 96 is engaged with connecting means.

Preferably, there are provided two tubular elements 96 and the connecting elements 80 couple therewith.

According to a preferred embodiment, the first seating body 52 and the second seating body 54 are slidingly engageable to each other, for adapting the length of the seating unit 50 to the door shutter thickness.

The first body 52 and the second body 54 are relatively translatable, remaining in engagement with each other, between a maximum extension configuration and a minimum extension configuration.

Preferably, the first seating body 52 comprises a first bottom 52*a*, wherein there is obtained front room 58, and at least a first guiding wall 52*b*, axially projecting from the first bottom 52*a* on the side opposite the front room 58. Moreover, the second seating body 54 comprises a second bottom 54*a*, wherein there is obtained the front room 60, and at least a second guiding wall 54*b*, axially projecting from the second bottom 54*a* on the side opposite the front room 60.

Preferably, the second guiding wall 54*b* comprises, at the distal end from the second bottom 54*a*, interconnecting tongues 54*c*, of reduced section as compared to the remaining portion of guiding wall.

The guiding walls 52*b*, 54*b* are slidingly engageable.

In the minimum extension configuration, the distance between the first bottom 52*a* and the second bottom 54*a* is the minimum structurally possible.

In the minimum extension configuration, the second guiding wall 54*b* penetrates at least partly through openings 53 in the first bottom 52*a*. In particular, in the minimum extension configuration, interconnecting tongues 54*c* penetrate through the openings 53 in the first bottom 52*a*, protruding into the front room 58 of the first seating body 52.

According to a preferred embodiment, the lock device 1 comprises locking means suitable for being manually actuated for locking the engagement unit 20 in forward configuration or for locking handle 10 in rest configuration.

Locking means can be influenced from the outside through an unlock key 100 for unlocking the engagement unit 20 from the forward configuration or for unlocking handle 10 from the rest configuration.

For example, locking means comprise a lock pin actuable, from one side of the lock device, for locking the engagement unit 20 or handle 10. On the other side of the lock device there is provided a hole made for reaching the locking pin with unlock key, for unlocking the locking means in the event of an emergency.

According to a preferred embodiment, the lock device 1 comprises coverings 110 suitable for covering covers 70, 90, for hiding seating unit 50 when mounted on the door shutter.

Moreover, the lock device 1 comprises an externally threaded bush 120 having an annular projection 122. Bush 120 is screwable to cover 70, 90 of the seating unit 50 for coupling covering 110 to the seating unit 50 through the annular projection 122.

Preferably, bush 120 exhibits recesses 124, or projections, suitable for coupling to a mounting tool 130 for screwing/unscrewing the bush. The mounting tool 130 exhibits elements suitable for coupling with shape coupling to bush 120, for example teeth 132 suitable for inserting in recesses 124.

Innovatively, the simplification of the connections between the covers and the seating bodies allows having more space in the front rooms for turning the handle.

In fact, for the lock device described above, the handle has an angular stroke of 60 hexadecimal degrees available for the rotation, almost twice the stroke available for the known embodiments.

Moreover, advantageously, the seating unit that withstands actions due to the handle actuation, exhibits a compact and resistant structure.

According to a further advantageous aspect, the covers remain perfectly adhering to the seating bodies.

According to an even further advantageous aspect, the seating unit is suitable for being mounted on thick doors and thin doors. In particular, the unit according to the present invention can be mounted on doors having a shutter with thickness between 60 millimetres and 30 millimetres. Known embodiments, on the other hand, are not suitable to be mounted on thinner thicknesses.

Advantageously, moreover, the seating unit according to the present invention allows keeping the handle aligned with the horizontal, compensating the specific weight of the handle.

According to a further advantageous aspect, the cover is fixed in a steady manner to the seating unit, so that an accidental disconnection therefrom is impossible.

Finally, according to an embodiment variation, covers 70, 90 comprise a collar 140 projecting from the cover body outwards. Collar 140 is suitable for seating spring holder bodies for shaped covers.

What is claimed is:

1. A lock device for a door, the lock device comprising:

at least one handle arranged to be turned from a rest configuration to an actuation configuration;

an engagement unit arranged to engage a door with a jamb in a forward configuration and to release the door from the jamb in a retracted configuration such that the rest configuration of the at least one handle corresponds to the retracted configuration of the engagement unit and the actuation configuration of the at least one handle corresponds to the forward configuration of the engagement unit;

a first return device and a second return device arranged to bias the at least one handle from the actuation configuration toward the rest configuration;

a seating unit arranged to be mounted through the door, the seating unit being coupled to the at least one handle and to the engagement unit; wherein the seating unit includes:

a first seating body and a second seating body arranged to slidingly engage each other to adjust a length of the seating unit based on a thickness of the door; wherein the first seating body includes a first front room on a bottom of the first seating body arranged to accommodate the first return device, at least one first guiding wall projecting axially from a side of the first seating body opposite to the bottom, and a first cover arranged to at least partially cover the first front room;

the second seating body includes a second front room on a bottom of the second seating body arranged to accommodate the second return device, at least one second guiding wall projecting axially from a side of the second seating body opposite to the bottom of the second seating body, and a second cover arranged to at least partially cover the second front room, wherein the at least one second guiding wall penetrates through the bottom of the first seating body and protrudes at least partially into the first front room of the first seating body when a distance between the first seating body and the second seating body is a minimum structurally possible amount; and the at least one first guiding wall and the at least one second guiding wall are arranged to face each other and slidingly engage with each other;

at least a first single connecting element is arranged to mechanically connect the first cover, the first seating body, the second seating body, and the second cover to each other;

a first covering arranged to cover the first cover and the first front room; and a second covering arranged to cover the second cover and the second front room.

2. The lock device according to claim 1, further comprising:

a first externally threaded bush including an annular projection, the first externally threaded bush arranged to screw the first covering to the seating unit; and a second externally threaded bush including an annular projection, the second externally threaded bush arranged to screw the second covering to the seating unit.

3. The lock device according to claim 2, wherein each of the first and second externally threaded bushes includes a recess arranged to be coupled to a mounting tool to screw or unscrew the first and second externally threaded bushes.

* * * * *